US012139921B2

(12) United States Patent
Sellers

(10) Patent No.: US 12,139,921 B2
(45) Date of Patent: Nov. 12, 2024

(54) POLE COVER ASSEMBLY FOR A STREET POLE, SIGN AND OTHER OBJECTS FOR IMPROVING VISIBILITY AND AESTHETIC APPEAL

(71) Applicant: Jeff Sellers, Kyle, TX (US)

(72) Inventor: Jeff Sellers, Kyle, TX (US)

( * ) Notice: Subject to any disclaimer, the term of this patent is extended or adjusted under 35 U.S.C. 154(b) by 187 days.

(21) Appl. No.: 17/989,152

(22) Filed: Nov. 17, 2022

(65) Prior Publication Data

US 2023/0151631 A1 May 18, 2023

Related U.S. Application Data

(60) Provisional application No. 63/280,937, filed on Nov. 18, 2021.

(51) Int. Cl.
*E04H 12/00* (2006.01)
*E01F 9/60* (2016.01)
*E04H 12/22* (2006.01)

(52) U.S. Cl.
CPC ..... *E04H 12/2292* (2013.01); *E01F 9/60* (2016.02)

(58) Field of Classification Search
CPC ..... E04H 12/2253; E04H 12/2269; E04H 12/2292; E04H 12/00; E01F 9/60
See application file for complete search history.

(56) References Cited

U.S. PATENT DOCUMENTS 2,897,553 A * 8/1959 Gorrow ..... F16J 15/025 52/835
5,311,713 A * 5/1994 Goodrich ..... E04H 12/2292 52/301
5,380,131 A * 1/1995 Crawford ..... E02D 5/60 405/211
5,974,712 A 11/1999 Laine
(Continued)

FOREIGN PATENT DOCUMENTS

AU 2020201094 9/2020
CN 208830813 5/2019
(Continued)

OTHER PUBLICATIONS

Ideal Shield; U-Channel Post Covers; https://www.idealshield.com/products/sign-base-sign-systems/u-channel-covers.
(Continued)

*Primary Examiner* — Chi Q Nguyen
(74) *Attorney, Agent, or Firm* — HULSEY P.C.

(57) ABSTRACT

A pole cover assembly for covering a pole including first sleeves or base sleeves, second sleeves or middle sleeves, and third sleeves or top sleeves or top cap. The pole cover assembly may also contain additional spacer sleeves. The pole cover assembly includes first sleeves, the second sleeves, and the third sleeves which come in front and rear semi-cylindrical tubes that snap together via inconspicuous tabs. Further, each of the first sleeves, the second sleeves, and the third sleeves include a series of disks that accommodate most type of poles i.e., square, round, and U-channel
(Continued)

poles. The pole cover assembly acts as a cover for the poles and can snap around almost all types and sizes of poles. The pole cover assembly beautifies and brings visibility to any pole.

20 Claims, 7 Drawing Sheets

(56) References Cited

U.S. PATENT DOCUMENTS

| | | | | |
|---|---|---|---|---|
| 6,009,683 | A * | 1/2000 | Grewe | E04C 3/30 52/301 |
| 6,098,353 | A | 8/2000 | Stanfield | |
| 6,148,585 | A * | 11/2000 | Baker | E04C 3/30 52/489.1 |
| 6,622,451 | B1 * | 9/2003 | Ellis | B44C 3/12 428/36.9 |
| 6,886,296 | B1 * | 5/2005 | John | E04H 12/2292 52/165 |
| 6,898,882 | B2 | 5/2005 | Kim | |
| 6,948,283 | B2 * | 9/2005 | Burkart | C08G 18/6692 52/169.9 |
| 7,199,222 | B2 * | 4/2007 | Shultz | C12P 21/005 435/183 |
| 7,243,473 | B2 * | 7/2007 | Terrels | E04C 3/32 52/843 |
| 7,992,362 | B2 * | 8/2011 | Petta | E04C 3/30 52/855 |
| 8,104,249 | B2 * | 1/2012 | Griffiths | F16B 23/0069 138/155 |
| 9,909,270 | B1 | 3/2018 | Bonifacio et al. | |
| 11,035,142 | B2 | 6/2021 | Knudsen | |
| 11,124,934 | B2 * | 9/2021 | Beason | E01F 9/685 |
| 2004/0148831 | A1 | 8/2004 | Johnston | |
| 2007/0033896 | A1 | 2/2007 | Wasiukiewicz | |
| 2013/0175422 | A1 | 7/2013 | Bae et al. | |
| 2021/0207376 | A1 | 7/2021 | Knudsen | |

FOREIGN PATENT DOCUMENTS

| | | |
|---|---|---|
| CN | 213867471 | 8/2021 |
| CN | 214033452 | 8/2021 |
| DE | 102011014786 | 9/2012 |
| DE | 202019102100 | 5/2020 |
| EP | 2103740 | 9/2009 |
| GB | 834534 | 5/1960 |
| GB | 2555065 | 11/2018 |
| JP | 2003027430 | 1/2003 |
| JP | 2016061111 | 4/2016 |
| KR | 100520307 | 10/2005 |
| KR | 101116911 | 2/2012 |
| KR | 101672276 | 11/2016 |
| KR | 102285053 | 8/2021 |
| WO | 9502090 | 1/1995 |

OTHER PUBLICATIONS

PWS; Plastic Pole Covers; http://www.pwssigns.com/portable-intelligent-traffic-management-system.

Pole Base Covers; Complete Safe Cover; https://www.polebasecovers.net/product/complete-safe-cover.

Bollards and Sleeve LLC; U-Channel Post Covers; https://bollardsleeves.com/u-channel-post-covers.

Bright Lots; Aluminum Decorative for 3" Round Poles—PAA-DR308017; https://brightlots.com/product/aluminum-decorative-for-3%e2%80%b3-round-poles-paa-dr308017.

Bright Lots; Aluminum Decorative for 4" Square Poles PAA-DS420; https://brightlots.com/product/aluminum-decorative-for-4-square-poles.

Bright Lots; Square ABS Plastic for Square Poles; https://brightlots.com/product/square-abs-plastic-for-square-poles-2.

Post Guard; Light Pole Guard; https://www.postguard.com.

Architectural Mall Inc; Half, Split, Column Wraps, Surrounds or Covers; https://columnsandbalustrades.com/split-columns.

Rennicks; Post Covers; http://rennicks.ie/shop/permanent-signs/sign-supports/post-covers.

* cited by examiner

POLE COVER ASSEMBLY FOR A STREET POLE, SIGN AND OTHER OBJECTS FOR IMPROVING VISIBILITY AND AESTHETIC APPEAL

CROSS-REFERENCE TO RELATED APPLICATIONS

This application claims priority to a U.S. Provisional Patent Application No. 63/280,937, filed Nov. 18, 2021 with title of POLE COVER ASSEMBLY FOR A STREET POLE, SIGN AND OTHER OBJECTS FOR IMPROVING VISIBILITY AND AESTHETIC APPEAL; which is hereby incorporated by reference in its entirety.

FIELD OF INVENTION

The present subject matter generally relates to pole covers. More specifically, the present subject matter relates to a pole cover assembly including sleeves for covering poles or posts such as sign poles, shopping cart corrals, billboards, playgrounds, mailboxes, fences, handrails, light poles, signal poles, utility poles, piping, flagpoles, parking meter poles, exposed pipes, trees, columns, etc.

BACKGROUND OF INVENTION

Poles or posts exist in every city and town throughout the world. The poles are often used for traffic signs, parking lot signs, light signals, decorative lights, directional signs, flagpoles, utilities, etc. Most poles are affixed directly to the ground, in concrete, or via a bolt system. Typical sign poles come in square, U-channel or round shaped structures. Some poles such as the sign poles come in the same dimensions as they follow the Manual for Uniform Traffic Control Devices (MUTCD). A typical sign pole is 8, 10, or 12 feet tall for street signs, stop signs, etc., but can be any length. Poles for other purposes such as signal poles or telephone poles are much taller and have wider diameters.

Generally, sign poles are made of bare metal and are not visually appealing. Further, the poles are cheap but functional. In addition to bare metal, the poles rust, lean, or bend. Cities collectively spend billions of dollars annually on beautification. However, very few cities can afford to purchase expensive decorative metal street poles.

To address the above problems, decorative poles are preferred. Decorative poles are typically round and fluted. Most decorative poles are metallic or fiberglass and come in black or some other colour that matches the brand of the community. The decorative poles are crash rated as they need to satisfy DOT or other safety requirements. Poles carry the weight of signs, lights, flowers, banners, signals, etc. As a result, they are heavy and can be expensive.

Other solutions include providing a sleeve assembly that fits around the pole. One such example is disclosed in a United States patent publication No. 20210207376, entitled, "Post sleeve assembly" ("the '376 Publication"). The '376 Publication discloses a post sleeve that provides a substantially permanent base for supporting a post for a fence or sign, and from which one post can be removed and replaced with another post. The sleeve includes a concrete body that is poured on site, using a sleeve core prepositioned in the post hole, and around which wet concrete is poured. After the concrete is cured, the core is removed, leaving a post sleeve cavity configured to receive a post. The core can be rigid or can include a flexible shell and stiffener. A preformed post sleeve top can be attached to the sleeve core and positioned therewith in the post hole, to become a permanent part of the post sleeve, once the concrete cures. A drain is attached to the core and remains in the sleeve when the core is removed, and can be a percolation chamber, or passage extending below the sleeve.

Another example is disclosed in a U.S. Pat. No. 9,909,270, entitled "Sign post cover" ("the '270 Patent"). The '270 Patent discloses a sign post cover comprised of a series of segments that are stacked to fit around a traffic control sign post. Segments have on one side facing the same direction as the sign on the sign post differing visual patterns that alternate between successive segments. A rear side of each segment includes an alternate pattern. This allows an observer from any direction to determine the nature of the sign and the direction which that sign faces.

Another example is disclosed in a United States patent publication No. 20040148831, entitled, "Pole advertising device" ("the '831 Publication"). The '831 Publication discloses a sign comprising two or more housings which are interlockingly connected together around a pole. Each housing has a selectively adjustable collar arrangement which can be adjusted to size to fit around the pole.

The above discussed disclosures provide a variety of solutions such as the decorative poles and the sleeve assembly for covering a pole. However, they cannot be used for covering different type of poles as they are configured for use with a particular type of poles only. Further, the decorative poles are installed replacing the exiting poles. It is far too expensive to replace all the existing poles with the decorative poles.

Therefore, there is a need for a pole cover assembly that can be used for connecting to almost all types and sizes of poles and present an inexpensive way to safely install and beautify the poles without removing existing signs or losing their functionality.

SUMMARY

It is an object of the present subject matter to provide a pole cover assembly and that avoids the drawbacks of known decorative poles and sleeve assemblies.

It is another object of the present subject matter to provide a pole cover assembly that can be used to cover any poles such as sign poles, shopping cart corrals, billboards, playgrounds, mailboxes, fences, handrails, light poles, signal poles, utility poles, piping, flagpoles, parking meter poles, exposed pipes, trees, columns, etc.

It is another object of the present subject matter to provide a pole cover assembly that can be easily snapped around a pole such as square, round, and U-channel having different shapes and sizes.

In order to achieve one or more objectives, the present subject matter presents a pole cover assembly having first sleeves (or base sleeves), second sleeves (or middle sleeves), and third sleeves (or top sleeves or top cap). Each of the first sleeves, the second sleeves, and the third sleeves come in segments of varying lengths. The first sleeves, the second sleeves, and the third sleeves come in front and rear halves that snap together via inconspicuous tabs. Further, each of the first sleeves, the second sleeves, and the third sleeves include a series of internal disks that accommodate the three most common pole types i.e., square, round, and U-channel poles. Once connected, the tabs are depressed and the pole cover assembly is removed to expose the pole for maintenance.

The pole cover assembly is installed over the pole by snapping the third sleeves around the pole. The second sleeves are installed by snapping each half around the pole, piece by piece depending on the length of the pole. Once the two halves are snapped together around the pole, they are then snapped into the third sleeves. Subsequently, the first sleeves are snapped together and then snapped into the second sleeves. This order may be reversed depending on the height of the pole and preference of the installer.

The first sleeves, the second sleeves, and the third sleeves snap together based on the height of the pole. Other sleeves are also available to function as "spacers" to ensure the covers reach their desired height. The total height of the pole assembly is selected such that the third sleeves terminate below the actual sign board.

In one advantageous feature of the present subject matter, the pole cover assembly can be used to snap around most standard metallic poles. In other words, the pole cover assembly includes internal disks made of a hardened High-density polyethylene (HDPE) that fit around most standard metal sign poles, but can also be designed to fit around all types and dimensions of poles. The pole cover assembly may present all the external appearances of a decorative sign or may be utilitarian depending on the specific use. Pole Covers are manufactured with a UV stabilizer to prevent them from fading or cracking in the sun. They have a retroreflective additive to be more visible at night. They may also be produced with different coloured dyes. The poles that can be covered using the pole cover assembly include, but not limited to, sign poles, shopping cart corrals, billboards, playgrounds, mailboxes, fences, handrails, light poles, signal poles, utility poles, piping, flagpoles, parking meter poles, exposed pipes, trees, columns, etc.

In another advantageous feature of the present subject matter, the pole cover assembly is not affixed to the ground or pole. Rather, the sleeves are snapped as covers around the pole. As such, they aren't affixed to the ground nor have need to be crash rated. Internal rubber shims affix to the disks and hold the covers tightly against any dimension pole. The rubber shims also act as shock absorbers from pole vibrations and prevent damage to the pole and covers. The pole cover assembly costs a fraction of traditional decorative metal or fiberglass poles, and doesn't require time-consuming installation and other maintenance costs. As the sleeves are snapped as covers around the pole, there is no risk of water harmlessly seeping out the bottom during a storm. The sleeves include a hole allowing the fresh air to pass through. This helps to prevent any sort of algae since there is fresh air blowing through the pole cover assembly.

In another advantageous feature of the present subject matter, the pole cover assembly acts as a cover for poles and can snap around almost all types and sizes of poles. The pole cover assembly beautifies and brings visibility to any pole and won't fade or crack in the sun. The pole cover assembly can be installed at a fraction of the cost of decorative metal and/or fiberglass poles and can be customized to any colour, shape, and design. The pole cover assembly allows to add text and other decorative aspects on them. The pole cover assembly enhances safety with night retro-reflectivity. The pole cover assembly can be manufactured with additives to protect them against fading and cracking, and as a result the lifespan can be increased.

In another advantageous feature of the present subject matter, the pole cover assembly includes internal disks that are specifically notched to accommodate multiple styles of poles. The pole cover assembly provides ornamental or decorative appeal.

Features and advantages of the subject matter hereof will become more apparent in light of the following detailed description of selected embodiments, as illustrated in the accompanying FIGURES. As will be realised, the subject matter disclosed is capable of modifications in various respects, all without departing from the scope of the subject matter. Accordingly, the drawings and the description are to be regarded as illustrative in nature.

BRIEF DESCRIPTION OF THE DRAWINGS

Further features and advantages of the present subject matter will become apparent from the following detailed description, taken in combination with the appended drawings, in which.

It will be noted that throughout the appended drawings, like features are identified by like reference numerals.

DETAILED DESCRIPTION OF THE EMBODIMENTS

Before the present features and working principle of a pole cover assembly is described, it is to be understood that this subject matter is not limited to the particular device as described, since it may vary within the specification indicated. Various features of a pole cover assembly might be provided by introducing variations within the components/subcomponents disclosed herein. It is also to be understood that the terminology used in the description is for the purpose of describing the particular versions or embodiments only, and is not intended to limit the scope of the present subject matter, which will be limited only by the appended claims. The words "comprising," "having," "containing," and "including," and other forms thereof, are intended to be equivalent in meaning and be open-ended in that an item or items following any one of these words is not meant to be an exhaustive listing of such item or items, or meant to be limited to only the listed item or items.

It should be understood that the present subject matter describes a pole cover assembly for covering a pole. The pole cover assembly includes first sleeves or base sleeves, second sleeves or middle sleeves, and third sleeves or top sleeves or top cap. Other spacer sleeves of varying heights may also be added to the construction of each assembly. The first sleeves, the second sleeves, and the third sleeves come in front and rear halves that snap together via inconspicuous tabs. Further, each of the first sleeves, the second sleeves, the third sleeves, and spacer sleeves, include a series of internal disks that accommodate most type of poles i.e., square, round, and U-channel poles. The pole cover assembly acts as a cover for the poles and can snap around almost all types and sizes of poles. The pole cover assembly beautifies and brings visibility to any pole or post.

Various features and embodiments of a pole cover assembly for covering a pole are explained in conjunction with the description of FIGS. 1-14.

Figure 1:
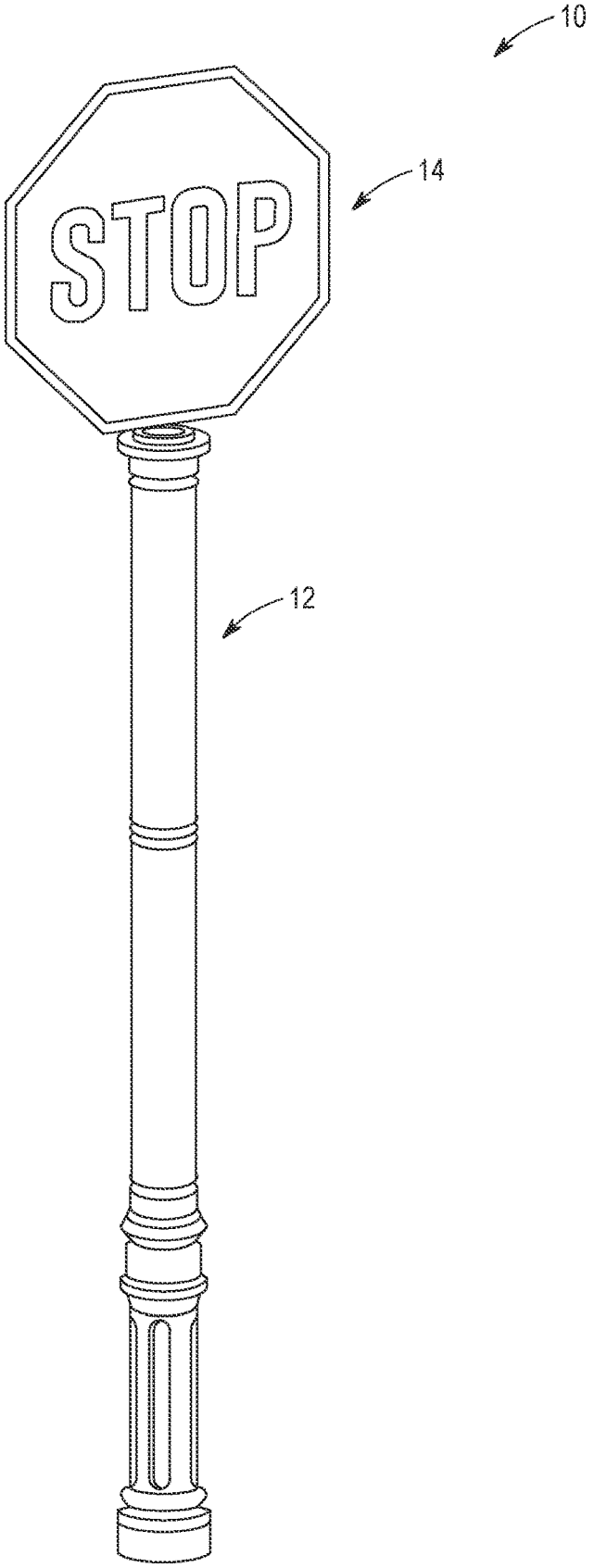
FIG. 1 illustrates an environment of a pole cover assembly placed around a pole, in accordance with one embodiment of the present subject matter.
Figure 2A:
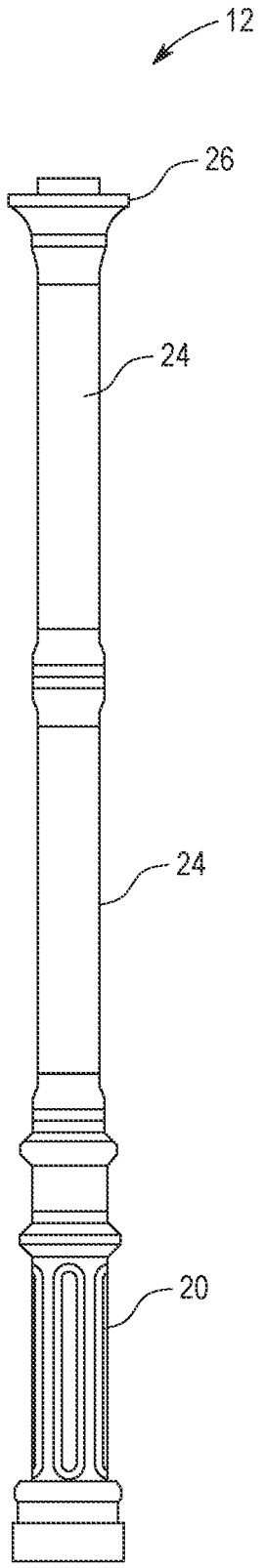
FIGS. 2A and 2B illustrate a front view and an exploded perspective view, respectively of the pole cover assembly, in accordance with one embodiment of the present subject matter.
Figure 2B:
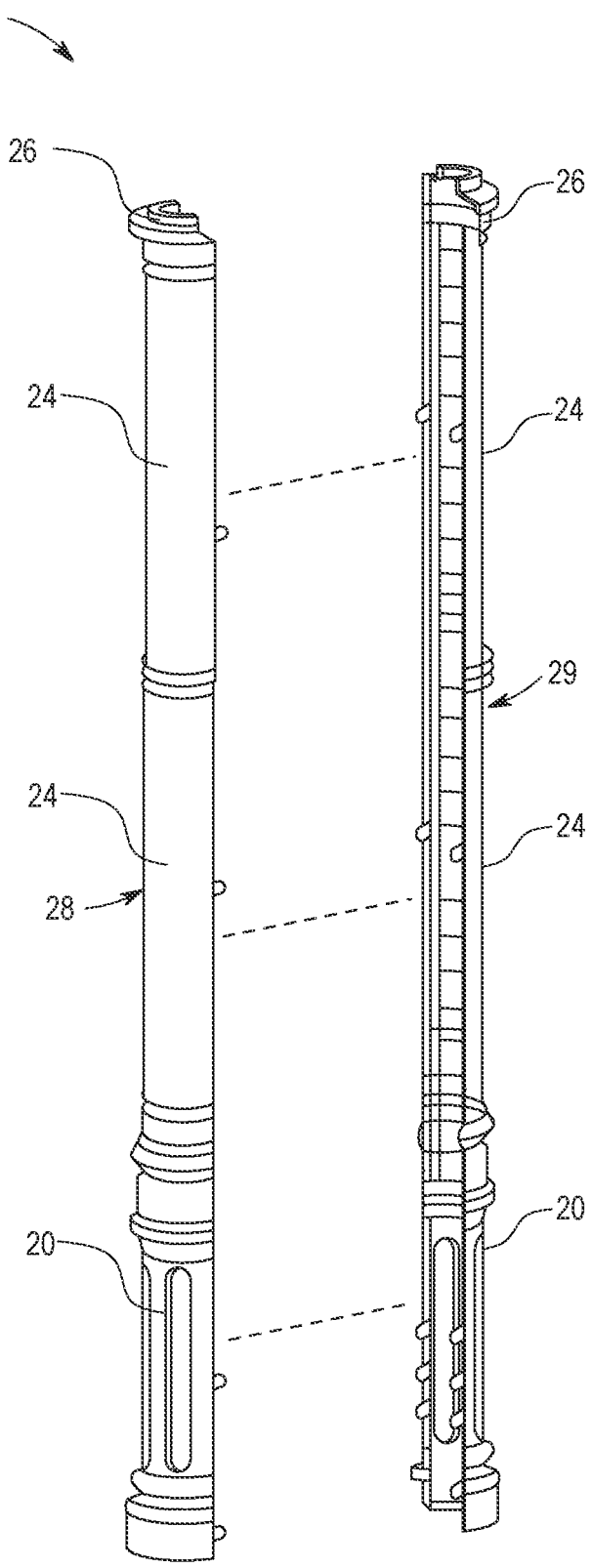

The present subject matter discloses a pole cover assembly for covering a pole. FIG. 1 shows an environment 10 of pole cover assembly 12 placed around pole 14, in accordance with one exemplary embodiment of the present subject matter. FIGS. 2A and 2B show a front view and an exploded perspective view, respectively of pole cover assembly 12, in accordance with one embodiment of the present subject matter. Pole cover assembly 12 includes first sleeves or base sleeves 20, one or more pair of second sleeves or middle sleeves 24, and third sleeves or top sleeves 26. Here, first sleeves 20 indicate base sleeves. One or more pair of second sleeves 24 indicate middle sleeves that mount over stack over one another. The bottom middle sleeves connect above first sleeves 20. Third sleeves 26 indicate top sleeves that connect at the top of middle sleeves 24. As can be seen in FIG. 2B, each of first sleeves 20, pair of second sleeves 24, and third sleeves 26 come as front halves 28 and rear halves 29 that intersect and snap together to form a complete first sleeves 20, pair of second sleeves 24, and third sleeves 26, respectively.

Figure 3:
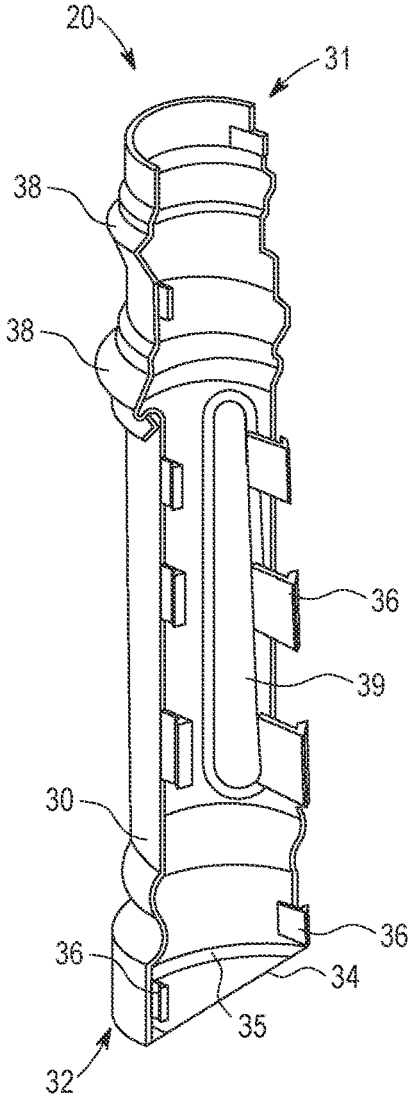
FIG. 3 illustrates a side perspective view of a first sleeve, in accordance with one embodiment of the present subject matter.

In the present subject matter, each front half 28 of first sleeves 20, pair of second sleeves 24, and third sleeves 26 have similar shape and size with that of rear half 29 of first sleeves 20, pair of second sleeves 24, and third sleeves 26. Front halves 28 and rear halves 29 snap together and appear as a complete structure. FIG. 3 shows a side perspective view of front half 28 of first sleeve 20, in accordance with one exemplary embodiment of present subject matter. First sleeve 20 presents elongated semi-cylindrical tube 30 made of metal, plastic, fiberglass, wood, or any other material. Elongated semi-cylindrical tube 30 encompasses first end 31 and second end 32. First end 31 indicates a top end and second end 32 indicates a bottom end of elongated semi-cylindrical tube 30. At second end 32, elongated semi-cylindrical tube 30 presents disk 34 (i.e., semi-circular disk). In one example, disk 34 includes a cushion member or rubber portion 35. Further, semi-cylindrical tube 30 includes tabs 36. Tabs 36 position at equal or varied distance from one another at both ends of the semi-cylindrical tube 30. Tabs 36 help to connect to the other half of semi-cylindrical tube 30 and form a complete first sleeve 20. In one example, semi-cylindrical tube 30 includes extending portions or ridges 38 at outer side for providing decorative appeal. In addition, semi-cylindrical tube 30 encompasses elongated sections 39 at outer side for providing decorative appeal.

Figure 4:
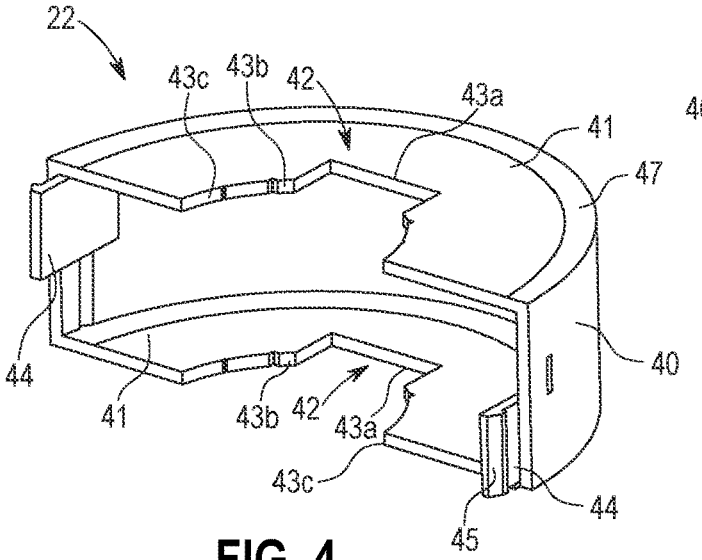
FIG. 4 illustrates a perspective view of front or rear half of a base, in accordance with one embodiment of the present subject matter.
Figure 5:
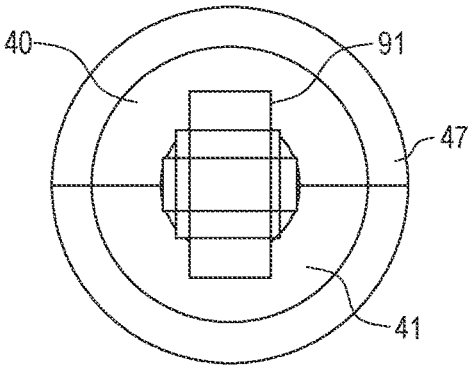
FIG. 5 illustrates a bottom view of disks, in accordance with one embodiment of the present subject matter.
Figure 14:
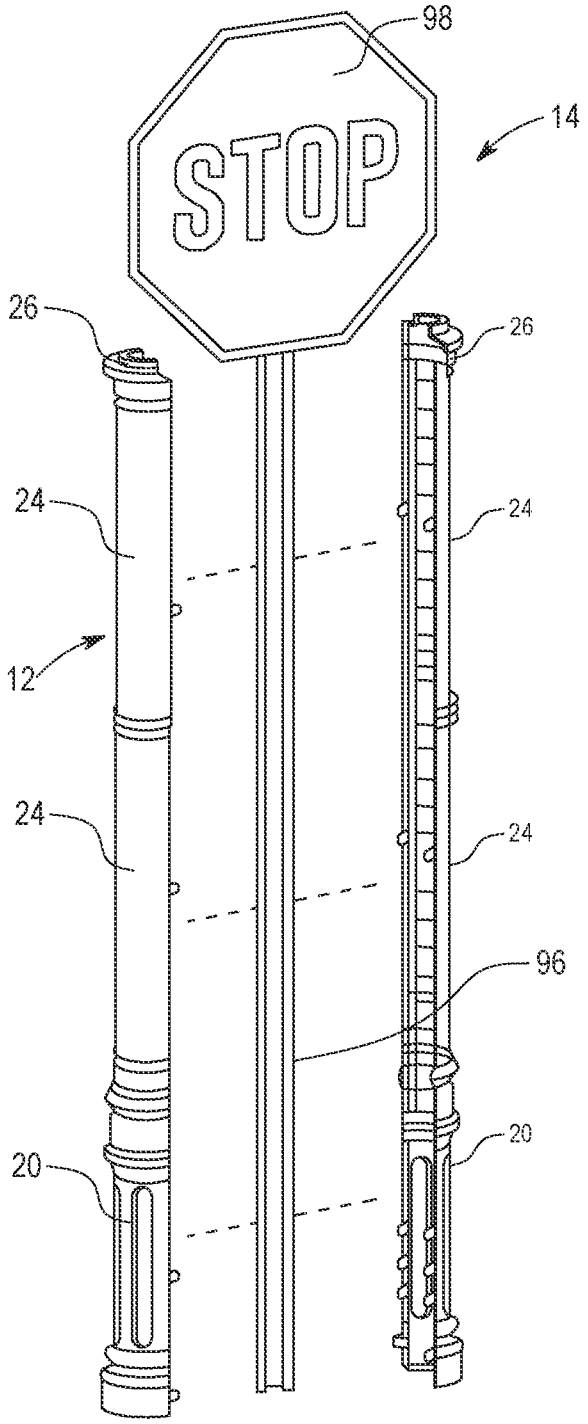
FIG. 14 illustrates the sleeves aligned the pole, in accordance with one embodiment of the present subject matter.

In one exemplary embodiment, pole cover assembly 12 includes a base. The base provides additional stability to the first sleeves and comes in contact with the ground. FIG. 4 shows a perspective view of front or rear half of base 22, in accordance with the present subject matter. Base 22 presents a semi-circular tube 30 made of plastic such as High-density polyethylene (HDPE). Semi-circular tube 40 encompasses disks 41 (i.e., semi-circular disks) at the top and the bottom. In one example, each disk 41 includes a cushion member 47. Cushion member 47 indicates a rubber part placed between disk 41 and semi-circular tube 40. Cushion member 47 helps to prevent the transmission of impact from semi-circular tube 40 to disk 41 and extends the life of cover 41. In other words, cushion member 47 acts as a protection for cover 41. Each disk 41 includes cut-section 42 having a square section 43*a*, circular section 43*b* and U-channel section 43*c*. Disks 41 connect and help to receive poles 14 having elongated rod of different shapes such as square poles, round poles, or U-channel poles, depending on the need. FIG. 5 shows a bottom view of disks 41 receiving poles 14 having elongated rod 96 (as shown in FIG. 14) in square, round, or U-channel shape, in accordance with one exemplary embodiment of the present subject matter. Further, semi-circular tube 40 presents tabs 44 having tab connecting portions 45. Tabs 44 extend from the distal ends of semi-circular tube 40. Tab connecting portions 45 extend from the outer surface of tabs 44 and help to connect opposite disk 41. Here, tabs 44 at first half 28 of semi-circular tube 40 face tabs 44 at second half 29 of semi-circular tube 40. This way, semi-circular tubes 40 of both first half 28 and second half 29 can be snapped together with the help of tabs 44 to form a complete base 22.

Figure 7:
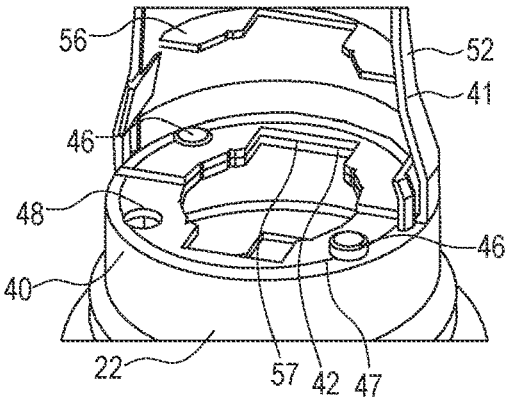
FIG. 7 illustrates the first sleeve connecting the base, in accordance with one embodiment of the present subject matter.

In one implementation, disks 41 further include first buttons 46 and first holes 48 for connecting first sleeves 20, as shown in FIG. 7. As can be seen in FIG. 7, first buttons 36 that extend from the surface of disk 41. Here, first buttons 36 connect to second holes 60 and second buttons 62 connect to first holes 38 in order to connect base 22 and first sleeves 20.

Figure 6:
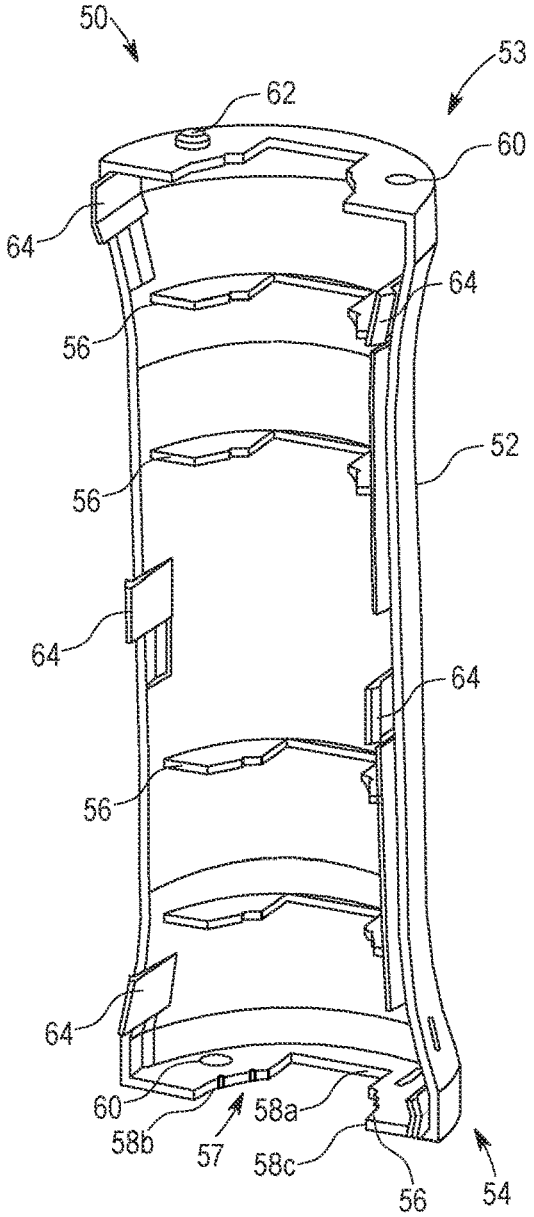
FIG. 6 illustrates a front perspective view of front half of a first sleeve, in accordance with another embodiment of the present subject matter.

FIG. 6 shows a front perspective view of front half 28 of first sleeve 50, in accordance with another exemplary embodiment of present subject matter. FIG. 6 is presented to show alternate embodiment of first sleeve 50 having second holes 60 and second buttons 62 that allow to connect to first buttons 46 and first holes 48 of base 22. A user of pole cover assembly 12 can choose any of first sleeve 20 or first sleeve 50 as base sleeves depending on the need. When the user selects first sleeve 20 as base sleeve, the user avoids using base 22. On the other hand, when the user selects first sleeve 50 as base sleeve, the user uses base 22 underneath first sleeve 50, as shown in FIG. 7.

In accordance with the present embodiment, first sleeve 50 presents elongated semi-cylindrical tube 52 made of plastic. Elongated semi-cylindrical tube 52 encompasses first end 53 and second end 54. First end 53 indicates a top end and second end 54 indicates a bottom end of elongated semi-cylindrical tube 52. Elongated semi-cylindrical tube 52 encompasses disks 56 (i.e., semi-circular disks) at the top and the bottom. Each disk 56 includes cut-section 57 having a square section 58*a*, circular section 58*b* and U-channel section 58*c*. Disks 56 having cut-sections 57 connect and help to receive poles 14 having elongated rod 96 of different shapes such as square poles, round poles, or U-channel poles depending on the need. The top and bottom disks 56 include second holes 60 and second buttons 62. Second holes 60 and second buttons 62 at second end 54 helps to connect first sleeve 50 to base 22 via first buttons 46 and first holes 48. FIG. 7 shows the feature of first buttons 46 connecting second buttons 62 and first holes 48 connecting second holes 60 in order to connect base 22 and first sleeve 50. Similarly, second holes 60 and second buttons 62 at first end 52 help to connect second sleeves 24 (via buttons and holes at second sleeves 24). Further, first sleeve 50 encompasses tabs 64 extending from ends of elongated semi-cylindrical tube 52. As explained above, tabs 64 at first half 28 of elongated semi-cylindrical tube 52 face tabs 64 at second half 29 of elongated semi-cylindrical tube 52. This way, elongated semi-cylindrical tubes 52 of both first half 28 and second half 29 can be snapped together with the help of tabs 64 to form a complete first sleeve 50.

Figure 8:
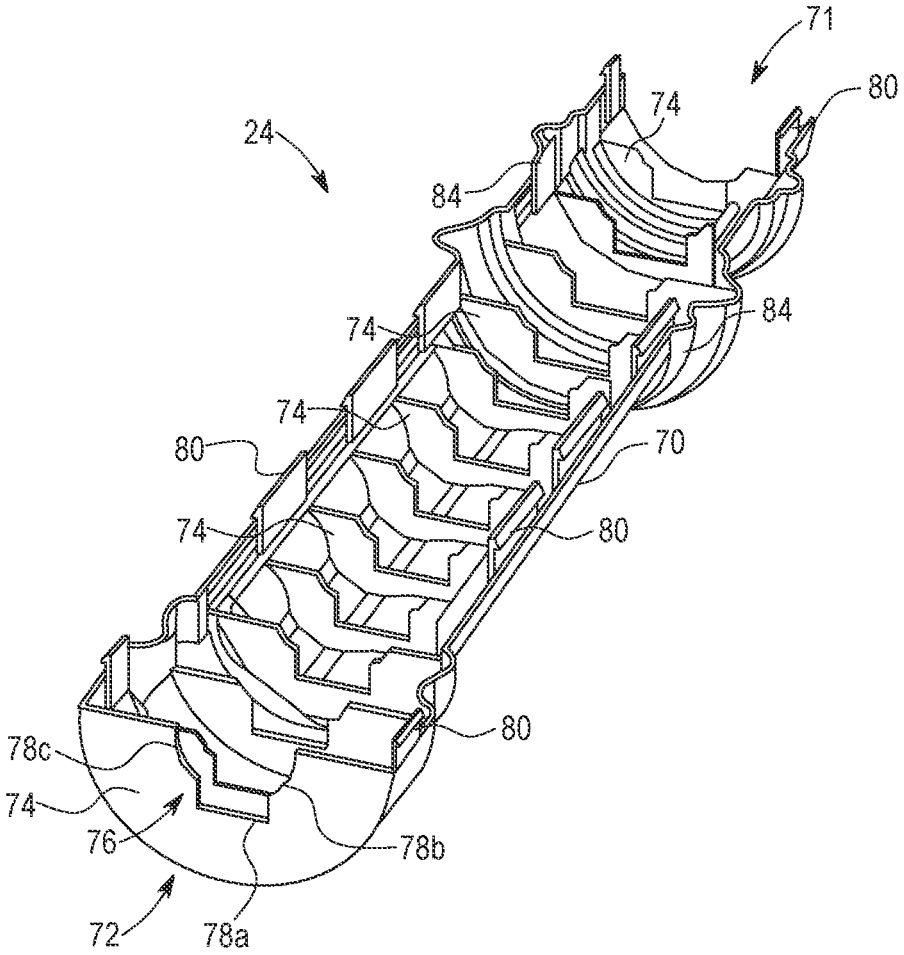
FIG. 8 illustrates a side perspective view of a second sleeve, in accordance with one embodiment of the present subject matter.
Figure 9:
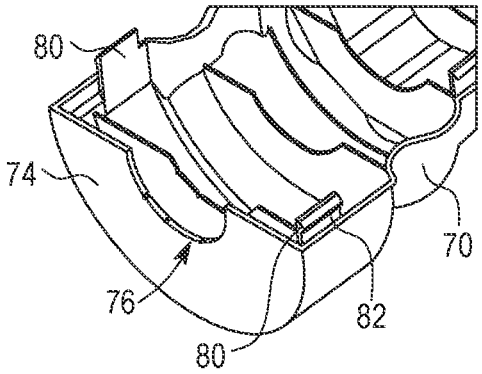
FIG. 9 illustrates a side perspective view of a second semi-cylindrical tube encompassing tabs, in accordance with one embodiment of the present subject matter.

FIG. 8 shows a side perspective view of second sleeve 24, in accordance with one embodiment of the subject matter. The user selects one or more second sleeves 24 depending on the height/length of elongated rod 96 of pole 14. Each second sleeve 24 presents second semi-cylindrical tube 70 made of plastic. Second semi-cylindrical tube 70 encompasses first end 71 and second end 72. First end 72 indicates a top end and second end 72 indicates a bottom end of second semi-cylindrical tube 70. Second semi-cylindrical tube 70 encompasses disks 74 (i.e., semi-circular disks) extending at equal or varied distance across the length of semi-cylindrical tube 70. In one example, each disk 74 encompasses a cushion member (not shown, similar to cushion member 35 and cushion member 47). The cushion member indicates a rubber part placed between disk 74 and semi-cylindrical tube 70. The cushion member helps to prevent the transmission of impact from semi-cylindrical tube 70 to disk 74 and extends the life of covers and pole 74. Each disk 74 includes cut-section 76 having a square section 78*a*, circular section 78*b* and U-channel section 78*c*. Disks 74 connect and help to receive poles 14 having elongated rod of different shapes such as square poles, round poles, or U-channel poles, depending on the need. Further, second sleeve 24 encompasses tabs 80 extending from the side ends of second semi-cylindrical tube 70. FIG. 9 shows the feature of second semi-cylindrical tube 70 encompassing tabs 80. Tabs 80 extend from the side ends of second semi-cylindrical tube 70. Tabs 80 include tab connecting portions 82. Tab connecting portions 82 position at the outer surface of tabs 80 and help to connect opposite half of second sleeve 24. In one example, second semi-cylindrical tube 70 includes extending portions or ridges 84 at outer side for providing decorative appeal.

Figure 10:
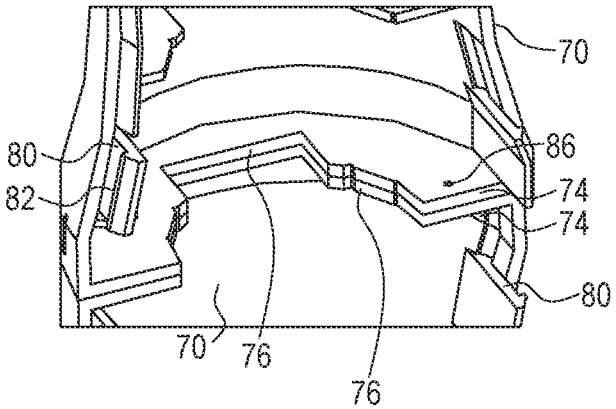
FIG. 10 illustrates the connection between the second sleeves, in accordance with one embodiment of the present subject matter.

As presented above, middle sleeves include one or more pair of second sleeves 24. Further, one or more pair of second sleeves 24 come in the same shape and size and are stacked over one another. In the present subject matter, when one or more pair of second sleeves 24 are stacked, disks 74 at the bottom of above positioned second sleeves 24 intersect with disks 74 at the top of second sleeves 24 positioned below, as shown in FIG. 10. Further, cut-sections 76 at one or more pair of second sleeves 24 align such cut-sections 76 can receive poles 14 of varied shapes and sizes. In one example, disks 74 include holes 86. Holes 86 allow for an optional set screw (not shown) to prevent separation of the sleeves by securing tabs 82 on each cylindrical tube 70.

Figure 11:
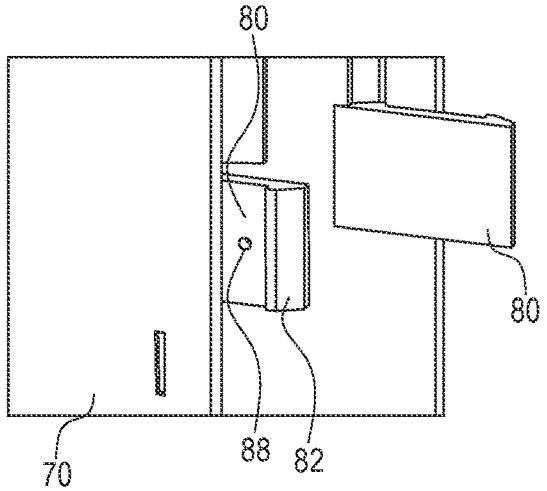
FIG. 11 illustrates the semi-cylindrical tube including holes, in accordance with one embodiment of the present subject matter.
Figure 12:
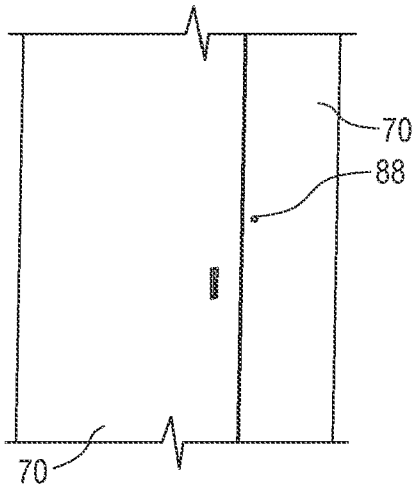
FIG. 12 illustrates a side view of the second sleeve including the holes, in accordance with one embodiment of the present subject matter.

In another example, tabs 82 at the end of semi-cylindrical tube 70 include holes 88 as shown in FIG. 11. When semi-cylindrical tubes 70 are snapped together to form a complete second sleeves 24, tabs 82 snap connect aligning holes 88, as shown in FIG. 12. Here, holes 88 allow for an optional set screw to prevent separation of the sleeves by securing tabs 82 on each cylindrical tube 70. Further, holes 88 maintain the structural integrity of tabs 82 and prevents them from breaking when they are connected or in use. In addition, holes 76 and 95 help to pass fresh air into the structure and prevent algae from forming inside pole cover assembly b12.

Figure 13:
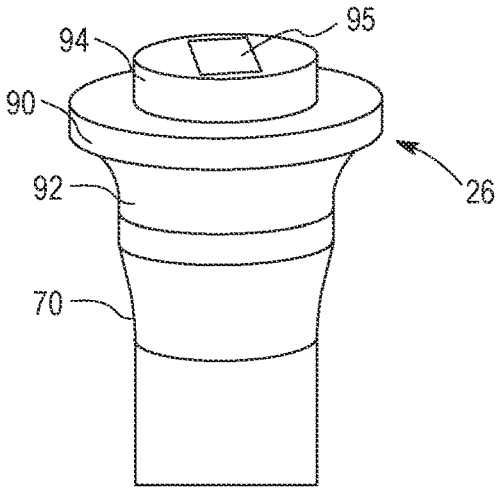
FIG. 13 illustrates a side perspective view of third sleeves, in accordance with one embodiment of the present subject matter.

As specified above, pole cover assembly 12 includes third sleeves 26 i.e., top sleeves. FIG. 13 shows a perspective view of third sleeves 26 positioned over second sleeves 24, in accordance with one embodiment of the present subject matter. Third sleeves 26 includes disk 90. Disk 90 presents curved section 92 underneath that connects at the top of second sleeves 24. Further, disk 90 includes circular head section 94 extending from the surface of disk 90. Head section 94 terminates just below where sign board 98 starts. In one example, disk 90 includes cut-section 95 for receiving pole 14 of various shapes and sizes as explained above.

Figure 15:
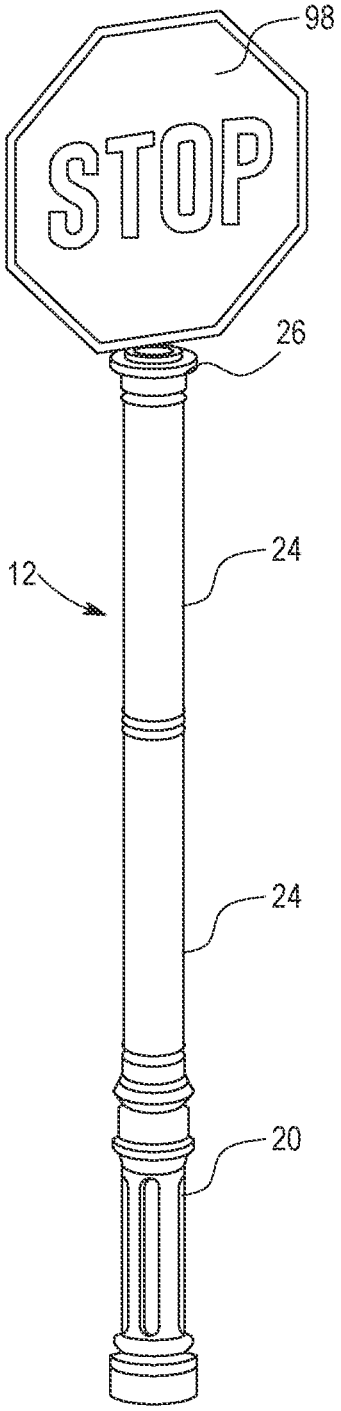
FIG. 15 illustrates the sleeves covering the pole, in accordance with one embodiment of the present subject matter.

FIGS. 14 and 15 show the feature of placing pole cover assembly 12 over pole 14 for covering it, in accordance with one embodiment of the present subject matter. At first, front halves 28 of first sleeves 20, second sleeves 24, and third sleeves 26 are stacked and connected over one another. Further, rear halves 29 of first sleeves 20, second sleeves 24, and third sleeves 26 are stacked and snap connected over one another. Subsequently, first sleeves 20, second sleeves 24, and third sleeves 26 are aligned with elongated rod 96 of pole 14 such that third sleeves 26 position just underneath sign board 98 (FIG. 15). Alternatively, pole cover assembly 12 is installed by snapping the top cap i.e., third sleeves 26 around elongated rod 96 of pole 14 first. Second sleeves 24 i.e., middle sections and spacers are installed by snapping each half around elongated rod 96 of pole 14, piece by piece depending on the length of pole 14. Once the two halves are snapped together around pole 14, they are then snapped into third sleeves 26. The bottom section i.e., first sleeves 20 is also snapped together and then snapped into the middle section i.e., second sleeves 24.

Subsequently, first sleeves 20, second sleeves 24, and third sleeves 26 are snapped together via inconspicuous tabs such that pole cover assembly 12 covers elongated rod 96 of pole 14, as shown in FIG. 14. When connected, the disks accommodate the shape of elongated rod 96 of pole 14.

Although the example illustrated in the above description shows the pole as a traffic sign post, it is obvious to use the presently disclosed pole cover assembly for covering other poles such as shopping cart corrals, billboards, playgrounds, mailboxes, fences, handrails, light poles, utility poles, piping, flagpoles, parking meter poles, exposed pipes, trees, columns, etc., without departing from the scope of the present subject matter.

In case of maintenance or removal, tabs are depressed and first sleeves 20, second sleeves 24, and third sleeves 26 are removed exposing elongated rod 96 of pole 14.

Although the above description is explained considering the sleeve halves come in a cylindrical shape, it is possible to provide each of the first sleeves (base sleeve), second sleeves (middle or center sleeve), and third sleeves (top sleeve or cap) in different shapes and sizes depending on the need without departing from the scope of the present subject matter. For example, the pole cover assembly can include a tapered base, tapered center, and tapered cap. In another example, the pole cover assembly can include a fluted base, a fluted center, a standard cap. The pole cover assembly can also include various spacer sleeves to account for varying pole heights. Further, the pole cover assembly can include tight square smooth sections with multi-coloured, and retroreflective surfaces.

In one implementation, the sleeves include a narrow plastic strip that snaps around the exterior of any sign, thus creating a decorative border that also brings attention to the sign. The strip is notched so as to be flexible allowing it to accommodate signs with different angles. The strip includes a deep groove on one side which fits along the edge of the sign. The plastic is manufactured so that the strip holds tightly and is not easily removable. The plastic is manufactured with retroreflective material so as to be visible at night. The plastic can be manufactured in any color. A decorative border can also be added to the strip to include logos or shapes. In this way a community may, for example, create a mold of its logo as a combined piece with the plastic strip and place it atop its street signs. Decorative shapes could be combined with the strips and placed all the way around a STOP sign or any other type of sign.

The presently disclosed pole cover assembly can be designed for almost any style of pole, including shopping cart corrals, billboards, playgrounds, mailboxes, fences, handrails, light poles, signal poles, utility poles, piping, flagpoles, parking meter poles, exposed pipes, trees, columns, etc. Further, each of the sleeves can be manufactured with specific designs and colours including logos and lettering depending on the need. Additional signs can be added to the outside of the pole cover assembly by drilling through the sleeves and attaching a long-threaded bolt to the inner aluminium pole. Signs may also be added by screwing directly into the plastic sleeves.

The presently disclosed pole cover assembly can come in a variety of colors to provide more visibility. This can be achieved by alternating the colors of the sleeves e.g., orange/white, red/white, or combination thereof. In addition, the pole cover assembly can be changed as per occasion such as Christmas or Valentine's day, or depending on the brands e.g., blue for Walmart™, red for Target™, etc.

As specified above, the sleeves are made of HDPE material. As such, in case of an accident e.g., a vehicle hits the pole cover assembly, the sleeves crack or crumple without becoming a flying projectile. Even if the sleeves crack and become airborne, the small pieces do not penetrate the windshield of the vehicle or become lethal unlike metallic poles.

Still further improvements to the preferred embodiment are within the scope of the disclosed subject matter. For instance, electronic circuitry may be placed within the covers to include sensors, cameras, electricity, Internet, etc. Pole Covers are a great way to hide these components. The internal ribs of the preferred embodiments provide a highly attractive space as well to locate this equipment. Or, a telescoping power pole further providing a solar panel for powering such circuitry. The presently disclosed system may further provide, for example, a 12" cover for such telescoping power poles when fully retracted.

Other improvements within the scope of the presently disclosed subject matter may include a spacer which may be offered for sale to provide an extending hook(s) to hold a hanging planter or a flag pole. Still other possibilities for extra pieces as well, may include a mounting bracket for speakers, banner flags, doggie waste bags, etc. The top cap could also include LED lights that shine up to illuminate the sign. Conversely, there could be LED lights in the toppers that shine down and illuminate the sign. A separate spacer may be designed to fit under the base to account for uneven terrain. For example, a wedge piece could be attached to the bottom for a sign on a slope to prevent unsightly gaps between the bottom and the ground.

A person skilled in the art appreciates that the pole cover assembly may come in a variety of sizes depending on the need and comfort of the user. Further, different materials in addition to or instead of materials described herein may also be used and such implementations may be construed to be within the scope of the present subject matter. Further, many changes in the design and placement of components may take place without deviating from the scope of the presently disclosed pole cover assembly.

In the above description, numerous specific details are set forth such as examples of some embodiments, specific components, devices, methods, in order to provide a thorough understanding of embodiments of the present subject matter. It will be apparent to a person of ordinary skill in the art that these specific details need not be employed, and should not be construed to limit the scope of the subject matter.

In the development of any actual implementation, numerous implementation-specific decisions must be made to achieve the developer's specific goals, such as compliance with system-related and business-related constraints. Such a development effort might be complex and time-consuming, but may nevertheless be a routine undertaking of design, fabrication, and manufacture for those of ordinary skill. Hence as various changes could be made in the above constructions without departing from the scope of the subject matter, it is intended that all matter contained in the above description or shown in the accompanying drawings shall be interpreted as illustrative and not in a limiting sense.

The foregoing description of embodiments is provided to enable any person skilled in the art to make and use the subject matter. Various modifications to these embodiments will be readily apparent to those skilled in the art, and the novel principles and subject matter disclosed herein may be applied to other embodiments without the use of the innovative faculty. It is contemplated that additional embodiments are within the spirit and true scope of the disclosed subject matter.

What is claimed is:

1. A pole cover assembly for covering a pole, said pole cover assembly comprising:

a sleeve comprising a pair of semi-cylindrical tubes;

disks provided at an interior of each of said semi-cylindrical tubes, wherein each disk of said disks comprises a cut-section having a square section, a circular section and a U-channel section; and tabs provided at distal ends along the length of each of said semi-cylindrical tubes, wherein said semi-cylindrical tubes align and receive said pole, wherein said pole comes in a square, tubular, rectangular or U-channel shape, wherein said disks receive said pole, and wherein said tabs of said semi-cylindrical tubes connect and position said sleeve around said pole as a cover.

2. The pole cover assembly of claim 1, wherein said tabs position at equal or varied distance from one another along the length of each of said semi-cylindrical tube.

3. The pole cover assembly of claim 1, wherein said semi-cylindrical tube comprises ridges at an outer side for providing a decorative appeal.

4. The pole cover assembly of claim 1, wherein said semi-cylindrical tube comprises an elongated section at an outer side for providing decorative appeal.

5. The pole cover assembly of claim 1, wherein each disk of said disks may comprise a cushion member, wherein said cushion member mounts between said disk and said semi-cylindrical tube, and wherein said cushion member withstands an impact transmitted from said semi-cylindrical tube onto said disk.

6. The pole cover assembly of claim 1, further comprising a base, wherein said base aligns and connects at the bottom of said sleeve.

7. The pole cover assembly of claim 6, wherein said base comprises a circular disk, wherein said circular disk comprises a second cut-section having a second square section, a second circular section and a second U-channel section, and wherein said circular disk aligns with said disk of said sleeve.

8. The pole cover assembly of claim 1, wherein said tabs comprises holes, wherein said holes allow insertion of a screw to prevent separation of said semi-cylindrical tubes, maintain the structural integrity of said tabs and prevent said tabs from breaking.

9. The pole cover assembly of claim 1, wherein said tabs comprises tab connecting portions, and wherein said tab connecting portions extend from an outer surface of said tabs and help to connect said tabs of said semi-cylindrical tube placed at an opposite side.

10. A pole cover assembly for covering a pole, said pole cover assembly comprising:

a first sleeve, wherein said first sleeve indicates a base sleeve;

a second sleeve, wherein said second sleeve indicates a top sleeve, wherein each of said first sleeve and said second sleeve comprises a pair of semi-cylindrical tubes;

disks provided at an interior of each of said semi-cylindrical tubes, wherein each disk of said disks comprises a cut-section having a square section, a circular section and a U-channel section; and tabs provided at distal ends along the length of each of said semi-cylindrical tubes, wherein said second sleeve positions over said first sleeve, wherein said semi-cylindrical tubes align and receives said pole, wherein said pole comes in a square, tubular, rectangular or U-channel shape, wherein said disks receive said pole, and wherein said tabs of said semi-cylindrical tubes connect, and said first sleeve and said sleeve act as covers for said pole.

11. The pole cover assembly of claim 10, further comprising a third sleeve comprising a pair of second semi-cylindrical tubes, wherein said third sleeve indicates a middle sleeve positioned between said first sleeve and said second sleeve, wherein said second semi-cylindrical tubes comprises second tabs.

12. The pole cover assembly of claim 11, wherein said second tabs position at equal or varied distance from one another along the length of each of said second semi-cylindrical tube.

13. The pole cover assembly of claim 10, wherein each of said semi-cylindrical tubes comprises ridges at an outer side for providing a decorative appeal.

14. The pole cover assembly of claim 10, wherein each of said semi-cylindrical tubes comprises an elongated section at an outer side for providing decorative appeal.

15. The pole cover assembly of claim 10, wherein each disk of said disks may comprise a cushion member, wherein said cushion member mounts between said disk and said semi-cylindrical tube, and wherein said cushion member withstands an impact transmitted from said semi-cylindrical tube onto said disk.

16. The pole cover assembly of claim 10, further comprising a base, wherein said base comprises a circular disk, wherein said circular disk comprises a second cut-section having a second square section, a second circular section and a second U-channel section, and wherein said circular disk aligns with said disk of said sleeve.

17. The pole cover assembly of claim 10, wherein said tabs comprises holes, wherein said holes allow insertion of a screw to prevent separation of said semi-cylindrical tubes, maintain the structural integrity of said tabs and prevent said tabs from breaking.

18. The pole cover assembly of claim 10, wherein said tabs comprises tab connecting portions, and wherein said tab connecting portions extend from an outer surface of said tabs and help to connect said tabs of said semi-cylindrical tube placed at an opposite side.

19. A method of providing a pole cover assembly for covering a pole, said method comprising the steps of:

providing a sleeve comprising a pair of semi-cylindrical tubes;

providing disks at an interior of each of said semi-cylindrical tubes, each of said disk comprising a cut-section having a square section, a circular section and a U-channel section;

providing tabs at distal ends along the length of each of said semi-cylindrical tubes;

aligning said semi-cylindrical tubes for receiving said pole, said pole having a square, tubular, rectangular or U-channel shape, receiving said pole at said disks; and connecting said tabs of said semi-cylindrical tubes and positioning said sleeve over said pole as a cover.

20. The method of claim 19, further comprising:

providing a base at the bottom of said sleeve, said base having a circular disk;

providing a second cut-section having a second square section, a second circular section and a second U-channel section at said circular disk; and aligning said circular disk with said disk of said sleeve.

* * * * *